US006694240B1

(12) United States Patent
Swick et al.

(10) Patent No.: US 6,694,240 B1
(45) Date of Patent: Feb. 17, 2004

(54) CONTROL SYSTEM FOR AND METHOD OF OPERATING A WORK MACHINE

(75) Inventors: W. Christopher Swick, Raleigh, NC (US); Clayton L. Padgett, Raleigh, NC (US); Gregory A. Epplin, Apex, NC (US); Christopher E. Bright, Raleigh, NC (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/232,358

(22) Filed: Aug. 29, 2002

(51) Int. Cl.[7] ..... G06F 17/00
(52) U.S. Cl. ..... 701/50
(58) Field of Search ..... 701/50, 35; 172/2; 180/170, 171

(56) References Cited

U.S. PATENT DOCUMENTS

| | | | |
|---|---|---|---|
| 4,369,856 | A | 1/1983 | Nudd |
| 4,373,850 | A | 2/1983 | Durham |
| 4,774,921 | A | 10/1988 | Sakaguchi et al. |
| 4,779,591 | A | 10/1988 | Tordenmalm |
| 4,838,755 | A | 6/1989 | Johnson et al. |
| 4,934,462 | A | 6/1990 | Tatara et al. |
| 4,989,567 | A | 2/1991 | Fujioka |
| 5,025,770 | A | 6/1991 | Richardson |
| 5,088,020 | A | 2/1992 | Nishida et al. |
| 5,092,408 | A | 3/1992 | Tatara et al. |
| 5,377,777 | A | 1/1995 | Moore et al. |
| 5,424,623 | A | 6/1995 | Allen et al. |
| 5,425,431 | A | 6/1995 | Brandt et al. |
| 5,471,908 | A | 12/1995 | Lech |
| 5,479,908 | A | 1/1996 | Grinberg et al. |
| 5,533,590 | A | 7/1996 | Steffen et al. |
| 5,995,893 | A | 11/1999 | Lee et al. |
| 6,061,617 | A | 5/2000 | Berger et al. |
| 6,131,062 | A | 10/2000 | Nielsen |
| 6,140,787 | A | 10/2000 | Lokhorst et al. |
| 6,220,567 | B1 | 4/2001 | Buelow |
| 6,226,902 | B1 | 5/2001 | Heyne |

*Primary Examiner*—Yonel Beaulieu
(74) *Attorney, Agent, or Firm*—Liell & McNeil; Diana Charlton

(57) ABSTRACT

When operating a work machine such as a backhoe, fuel consumption, pollution and noise can be decreased by reducing engine speed below a throttle setting when a set of equipment attached to a rear side of a work machine body is idled for a predetermined period of time. The engine speed is reduced by a control system including an electronic control module having an engine speed reduction algorithm. When the electronic control module determines that a seat assembly that is rotatably mounted to the work machine body is in a forward-facing position, the engine speed reduction algorithm is inactive. When the electronic control module determines that the seat assembly in a rearward-facing position, the engine speed reduction algorithm is active. By basing, at least in part, the activation and deactivation of the engine speed reduction algorithm on the seat assembly position, the engine speed reduction algorithm will be active when the backhoe is operable.

24 Claims, 5 Drawing Sheets

CONTROL SYSTEM FOR AND METHOD OF OPERATING A WORK MACHINE

TECHNICAL FIELD

The present invention relates generally to work machines, and more particularly to control systems for work machines with reorientable seat assemblies.

BACKGROUND

Engineers often seek strategies to reduce fuel consumption, noise, and pollution while not compromising the performance of a work machine. Work machines often include one or more hydraulically-controlled implements. For instance, a backhoe includes a loader and a digging implement. In order to operate the backhoe, hydraulic pressure is supplied to at least one hydraulic cylinder via a hydraulic pump that is powered by an engine. Thus, when the backhoe is being operated while the work machine is stationary, the operator may need to increase the engine speed in order to power the hydraulic pump and operate the backhoe. The operator may increase the engine speed by moving a throttle, usually a hand controller, from a throttle setting corresponding with a low idle engine speed to a throttle setting corresponding with an increased engine speed. However, when the operator stops using the backhoe, and the implement becomes idle or stationary, the throttle will remain at the setting corresponding with the increased engine speed until the operator moves the throttle back to the setting corresponding with the low idle engine speed.

Work machines such as the backhoe shown in U.S. Pat. No. 5,025,770 issued to Richardson on Jun. 25, 1991, conserve fuel and reduce noise and pollution by including an apparatus that reduces engine speed below the increased throttle setting when the implements, illustrated as the backhoe and a loader, have been idled for a predetermined time period and the transmission is not engaged. Although the Richardson apparatus may reduce fuel consumption by reducing engine speed when the backhoe is idle, the Richardson apparatus does not address at least some of the effects the engine speed reduction apparatus may have on the operation of a second set of equipment that could be attached to the work machine body. For instance, the work machine may have the backhoe attached to the rear side of the work machine body and a second set of equipment, such as a loader, attached to the front side of the work machine body. The Richardson apparatus operates similarly regardless of whether the operator is operating the backhoe or the loader. However, because the loader is generally used for shoveling material, the operator will often drive the work machine while operating the loader. Thus, when operating the loader, the transmission will be engaged, and the operator will control the engine speed with a second throttle controller, such as a foot pedal. When the operator no longer depresses the foot pedal, the engine speed should return to a low idle speed. Therefore, a method of reducing engine speed after the predetermined time of idling the loader may not be necessary.

Further, allowing the engine speed reduction apparatus to reduce the engine speed below the throttle setting regardless of which implement is enabled may result in undesirable movement of the work machine. For example, after the operator has ceased using the backhoe, the engine speed reduction apparatus may override the throttle setting and reduce the engine speed to the predetermined low idle speed. When the operator rotates his seat and engages the transmission to operate the loader, the engine speed may jump back up to the throttle setting, possibly causing the work machine to lurch forward. In addition, the Richardson apparatus appears to reduce engine speed mechanically, resulting in an increased number of moving work machine components.

The present invention is directed to overcoming one or more of the problems set forth above.

SUMMARY OF THE INVENTION

In one aspect of the present invention, a work machine includes a work machine body and an electronic control module including an engine speed reduction algorithm. A set of equipment is attached to the work machine body. A seat assembly is rotatably mounted to the work machine body and is movable between a first position and a second position. When the seat assembly is in the first position, the engine speed reduction algorithm is inactive, and when the seat assembly is in the second position, the engine speed reduction algorithm is active.

In another aspect of the present invention, a control system for use in a work machine includes a seat assembly position sensor that is in communication with an engine speed reduction algorithm of an electronic control module. The engine speed reduction algorithm is inactive when the electronic control module determines that a seat assembly is in a first position, and the engine speed reduction algorithm is active when the electronic control module determines that the seat assembly is in a second position.

In yet another aspect of the present invention, there is a method of operating a work machine. An engine speed reduction algorithm is activated, at least in part, when an operator rotates a seat assembly to a second position. The engine speed is reduced below a throttle setting via the engine speed reduction algorithm, at least in part, when the operator idles a set of equipment for a predetermined period of time.

DETAILED DESCRIPTION

Figure 1:
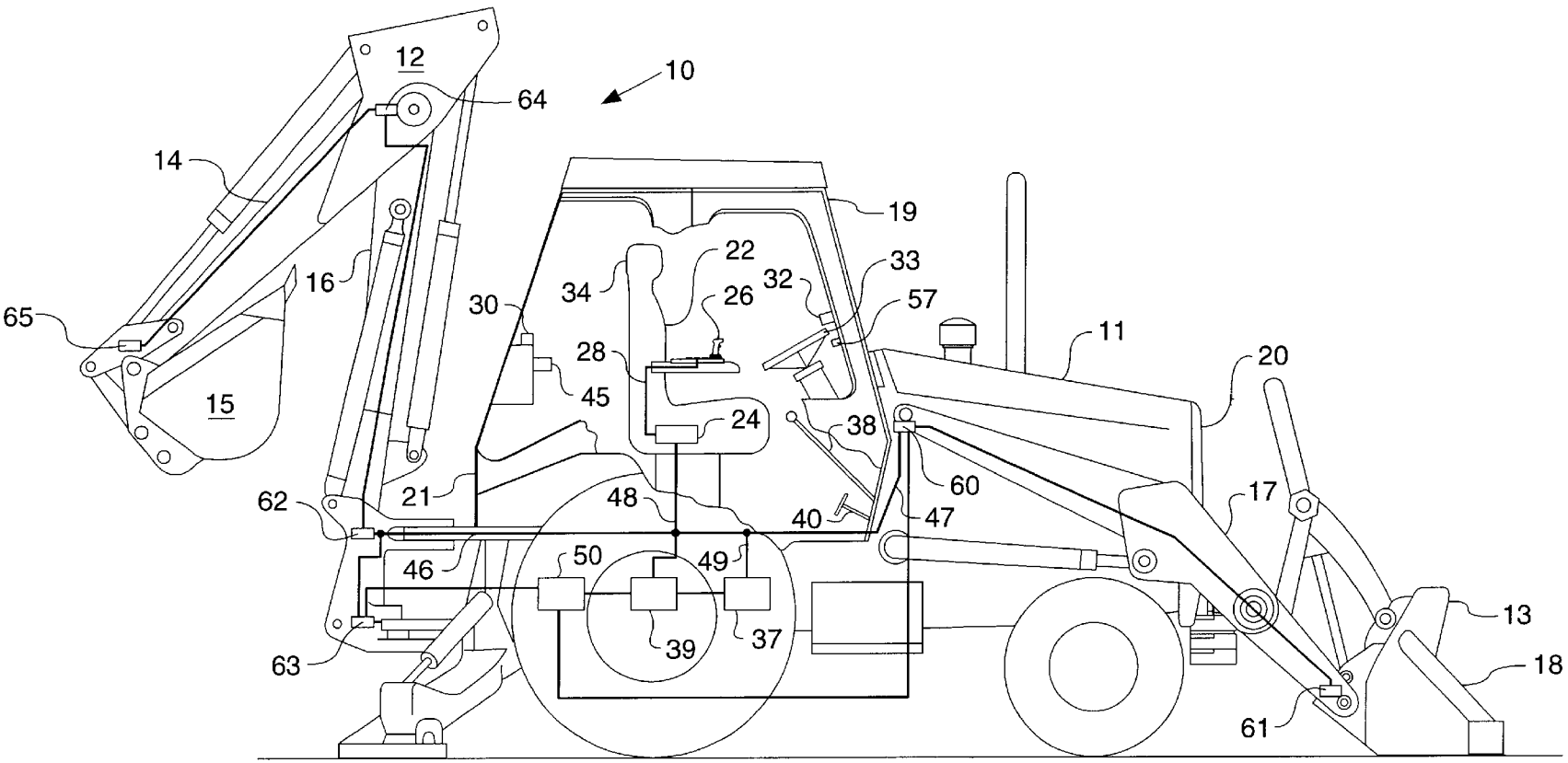
FIG. 1 is a side view of a backhoe loader including a seat assembly in a loader position, according to the present invention.
Figure 2:
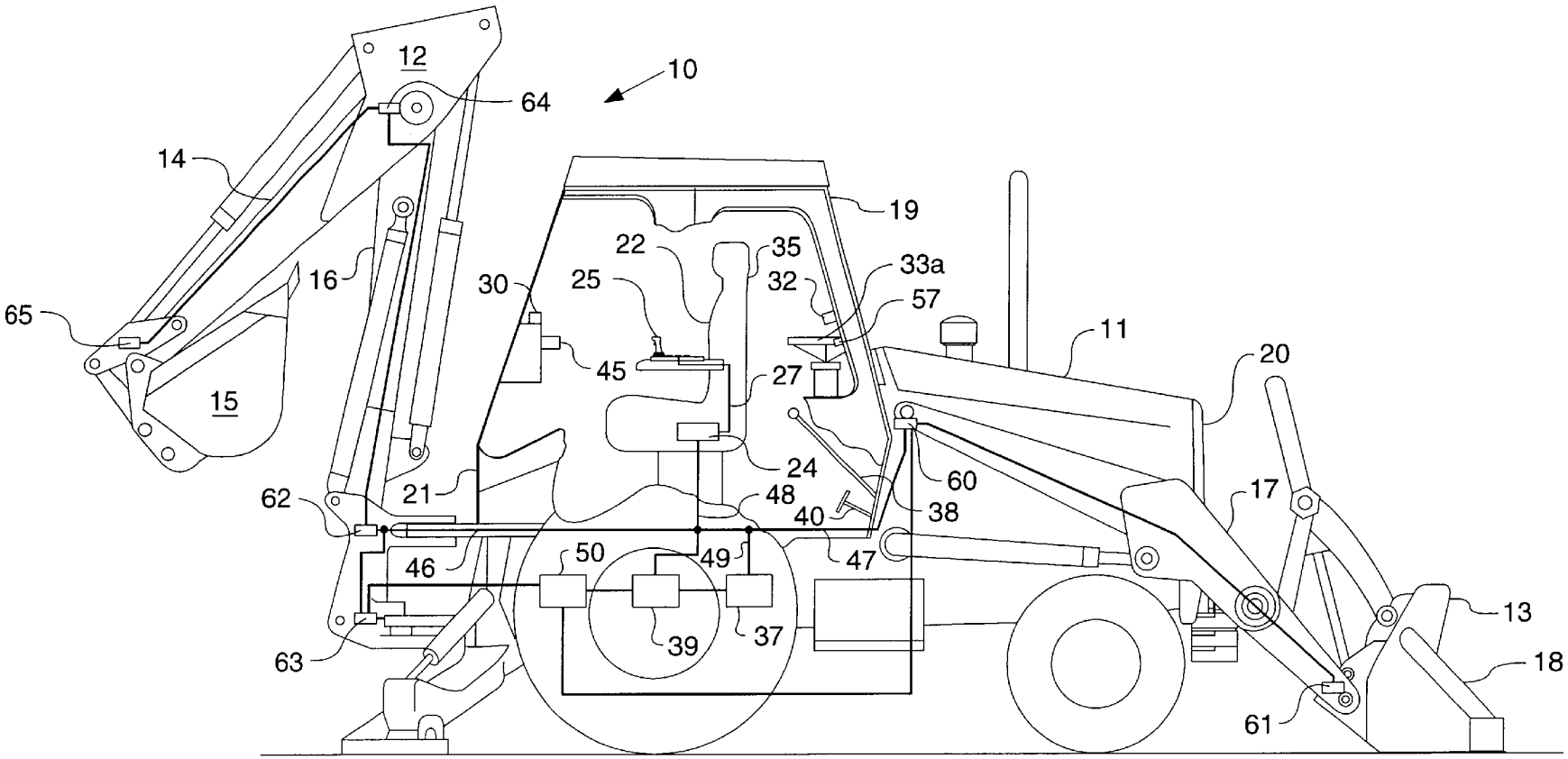
FIG. 2 is a side view of the backhoe loader including the seat assembly in a backhoe position, according to the present invention.
Figure 3:
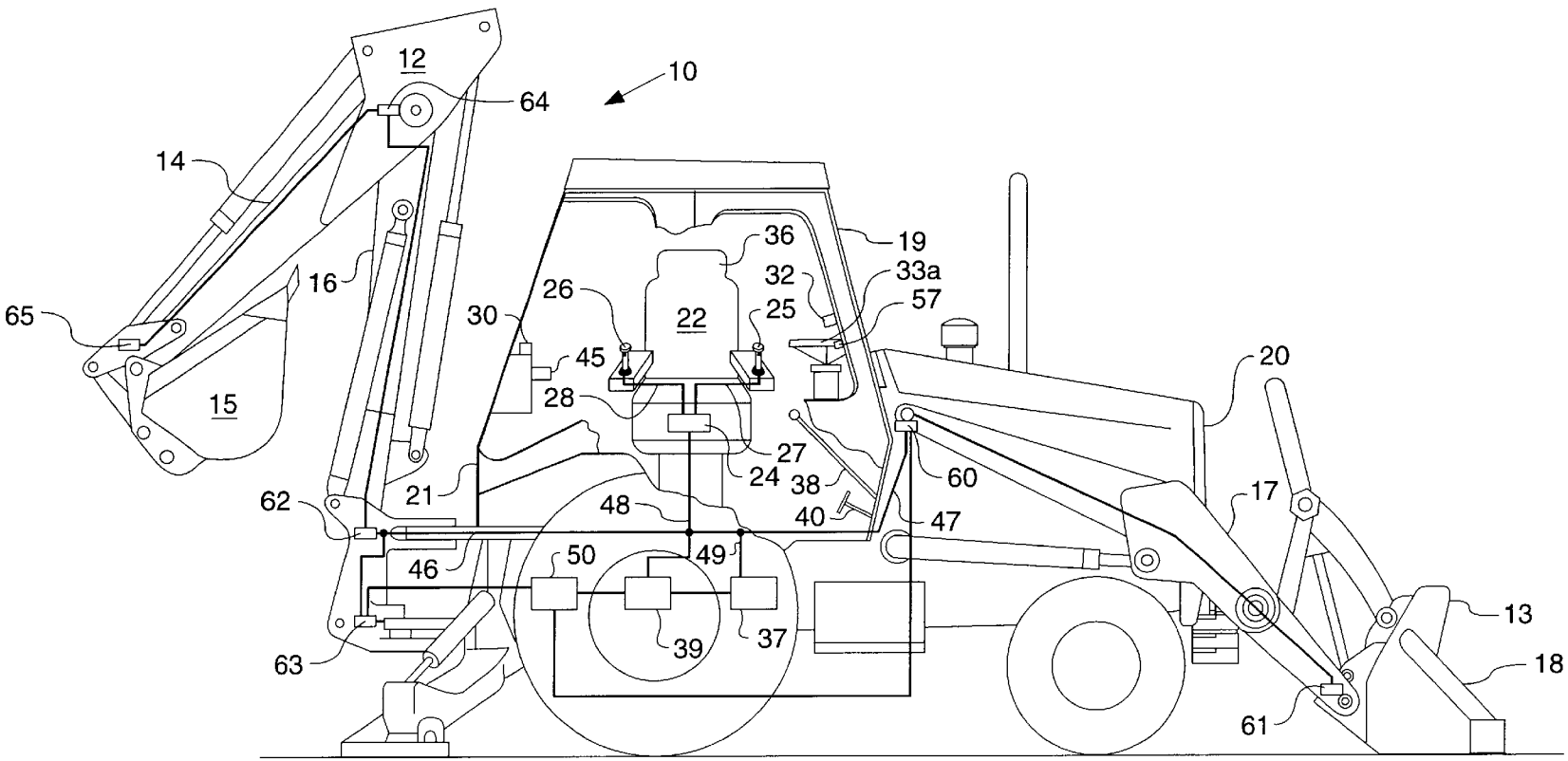
FIG. 3 is a side view of the backhoe loader including the seat assembly in a middle position, according to the present invention.

Referring to FIGS. 1–3, there are shown side views of a work machine, which in the illustrated example is backhoe loader. Those skilled in the art will appreciate that the present invention contemplates other work machines such as pavers and/or graders, where different aspects of the machine are operated from different seat positions. Thus, although the work machine is illustrated as a backhoe loader 10, it should be appreciated that the present invention contemplates other types of work machines. Those skilled in the art will appreciate that the term backhoe includes any work machine with at least one implement used for stationary digging. For instance, the present invention could be applied to a backhoe dozer having a backhoe used for stationary digging attached to a rear side of the work machine body and a dozer attached to a front side of the work machine body. Further, the present invention may apply to a backhoe in which some other tool has been substituted in place of the backhoe bucket, such as a ram.

The backhoe loader 10 includes a work machine body 11. Attached to a rear side 21 of the work machine body 11 is a set of equipment, preferably a backhoe 12 generally used for stationary digging. Attached to a front side 20 of the work machine body 11 is preferably a second set of equipment, shown as a loader 13 generally used for shoveling. The backhoe 12 includes a boom 16 that is moveably attached to the work machine body 11, and can be moved upward and downward and swung left and right about a vertical axis. A stick 14 is moveably attached to the boom 16 and can be moved inward and outward. The backhoe 12 also includes a material engaging member, shown as a backhoe bucket 15 that is moveably attached to the stick 14. The backhoe bucket 15 can be curled in order to dig, and can be uncurled outward in order to dump material. The loader 13 includes a pair of arms 17 movably attached to the first end 20 of the work machine body 11. The pair of arms 17 can be moved upward and downward in order to lift and lower a material engaging member, shown as a loader bucket 18. The loader bucket 18 is moveably attached to the pair of arms 17 and can be raised and lowered about a horizontal axis. There is at least one electronically controlled actuator attached to at least one hydraulic cylinder controlling the movement of each aspect of both the backhoe 12 and the loader 13. The illustrated backhoe loader 10 includes a loader arms actuator 60, a loader bucket actuator 61, a boom vertical movement actuator 62, a boom swing actuator 63, a stick actuator 64, and a backhoe bucket actuator 65. An engine 39, that is attached to the work machine body 11, is coupled to a transmission 37 in order to provide power for translational movement of the backhoe loader 10, and is coupled to at least one hydraulic pump 50 in order to provide power for operation of the backhoe 12 and the loader 13. The engine 39 powers the hydraulic pump 50 which supplies pressurized hydraulic fluid to the hydraulic cylinders via the electrical actuators 60, 61, 62, 63, 64, and 65. A throttle valve 52 controls the flow of fuel from the fuel pump to fuel injectors attached to the engine 38, and thereby controls the engine speed.

The backhoe loader 10 includes a cab 19 in which a seat assembly 22 is rotatably mounted to the work machine body 11. Although the seat assembly 22 preferably also includes translational movement, the seat assembly 22 rotates about a vertical axis between a forward-facing position illustrated as a loader position 34 in FIG. 1, a rearward-facing position illustrated as a backhoe position 35 in FIG. 2, and a middle-facing position 36 in FIG. 3. The loader position 34 is preferably a latched position, and is separated by approximately 180° from the backhoe position 35, also preferably a latched position. The middle-facing position 36 is preferably an unlatched position between the loader position 34 and the backhoe position 35. When the seat assembly 22 is in the loader position 34, the loader 13 is preferably enabled. When the seat assembly 22 is in at least one of the backhoe position 35 and the middle-facing position 36, the backhoe 12 is preferably enabled. A steering wheel 33 is preferably attached to the work machine body 11 such that when the seat assembly 22 is in the loader position 34, the operator can use the steering wheel 33. The steering wheel 33 can be stowed for operation of the backhoe loader 10 when the seat assembly 22 is in the backhoe position 35 or the middle-facing position 36. Although it should be appreciated that a transmission controller 38 could be attached to rotate with the seat assembly 22, the transmission controller 38 is illustrated as attached to the work machine body 11 such that when the seat assembly 22 is in the loader position 34, the operator can manipulate the transmission controller 38. An engine speed reduction disabling switch 31 is preferably attached to a console on the rear side 21 of the work machine body 11, and is moveable between an activated position and a de-activated position.

Although it should be appreciated that there could be only one manual throttle controller, the present invention is illustrated as including two manual throttle controllers 40, 45. A first throttle controller, preferably a handoperated throttle controller 45, is preferably moveably attached to the console on the rear side 22 of the work machine body 11. The operator can control the engine speed when the transmission 37 is not engaged by manipulating the hand-operated throttle controller 45. The hand operated throttle 45 is moveable between various throttle settings, including but not limited to, an increased throttle setting backhoe operation and a predetermined low idle engine setting. Each throttle setting corresponds with an engine speed. The increased throttle setting corresponds with an increased engine speed, such as over 1100 rpm in the illustrated embodiment. The predetermined low idle speed throttle setting in the illustrated embodiment could be less than 1000 rpm. Although the predetermined low idle speed and the increased engine speed may vary depending on the size and type of the backhoe, those skilled in the art should appreciate that the predetermined low idle speed is an engine speed that provides the minimum power required to maintain idling of the backhoe loader 10, and the increased engine speed **66*a* is an engine speed that provides sufficient power to operate the hydraulically-controlled backhoe 12. A second throttle controller, preferably a foot pedal 40, is attached to the work machine body 11, although it should be appreciated that the foot pedal 40 could be attached to the seat assembly 22 at a point that the operator can reach when operating the loader 13. The foot pedal 40 allows the operator to control the work machine speed when driving the backhoe loader 10 and, at least in part, when operating the loader 13. The throttle controllers 40, 45 and the transmission controller 38 are coupled to ECM 24 and the transmission 37, respectively. It should be appreciated that the throttle controllers 40, 45 and the transmission controller 38 could be mechanically operably coupled or electronically operably coupled via the electronic control module 24 to the to the fuel system and the transmission 37**, respectively.

Figure 4:
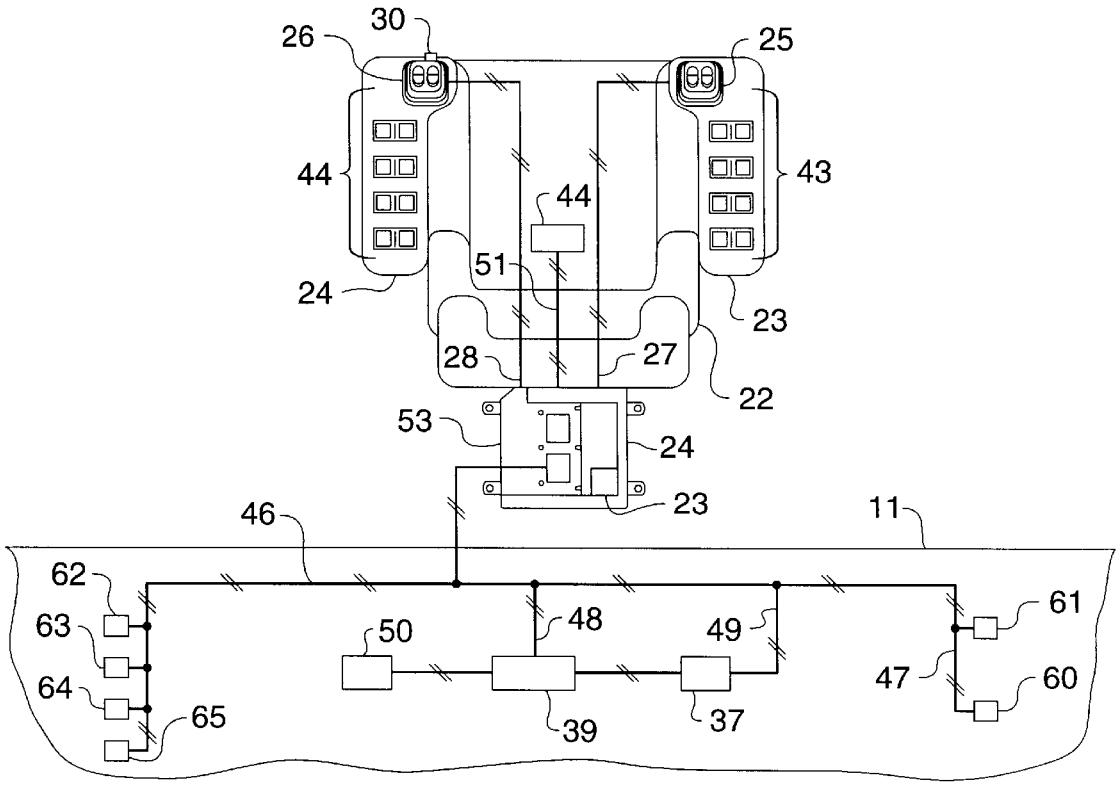
FIG. 4 is a top view of the seat assembly attached to the backhoe loader of FIGS. 1–3, according to the present invention.

Referring to FIG. 4, there is shown a top view of the seat assembly 22 attached to the backhoe loader 10 of FIGS. 1–3. There is a control system 53 including a seat assembly position sensor 44 in communication with the electronic control module 24 via a seat position sensor communication line 51. Although it should be appreciated that the electronic control module 24 could be located within the work machine body 11 or at any position within the seat assembly 22, the electronic control module 24 is illustrated as embedded in a seat of the seat assembly 22. Although implement controllers could be attached to the work machine body 11, a first joystick 25 and a second joystick 26 are preferably attached to a first side 43 of the seat assembly 22 and a second side 44 of the seat assembly 22, respectively. Although the joysticks 25 and 26 could be mechanically operably coupled to the loader 13 and the backhoe 12, the first joystick 25 and the second joystick 26 are preferably in communication with the electronic control module 24 via a first communication line 27 and a second communication line 28, respectively. An engine speed reduction controller 30, illustrated as a button attached to the second joystick 26, is moveable between a on position 30*a* and an off position, and is in communication with the electronic control module 24 via the second communication line 28. The electronic control module 24 is preferably in communication with the loader arms actuator 60 and the loader bucket actuator 61 via a loader communication line(s) 47, and is in communication with the boom vertical movement actuator 62, the boom swing actuator 63, the stick actuator 64, and the backhoe bucket actuator 65 via a backhoe communication line(s) 46. The electronic control module 24 is in communication with the engine 39 and the transmission 37 via a engine communication line 48 and a transmission communication line 49, respectively. Although the present invention is illustrated as including only one electronic control module 24, it should be appreciated that there could be any number of electronic control modules, including but not limited to, four additional electronic control modules, one to control each of the transmission 37, the backhoe 12, the loader 13, and the throttle valve 53, and each being in communication with the electronic control module 24.

Figure 5:
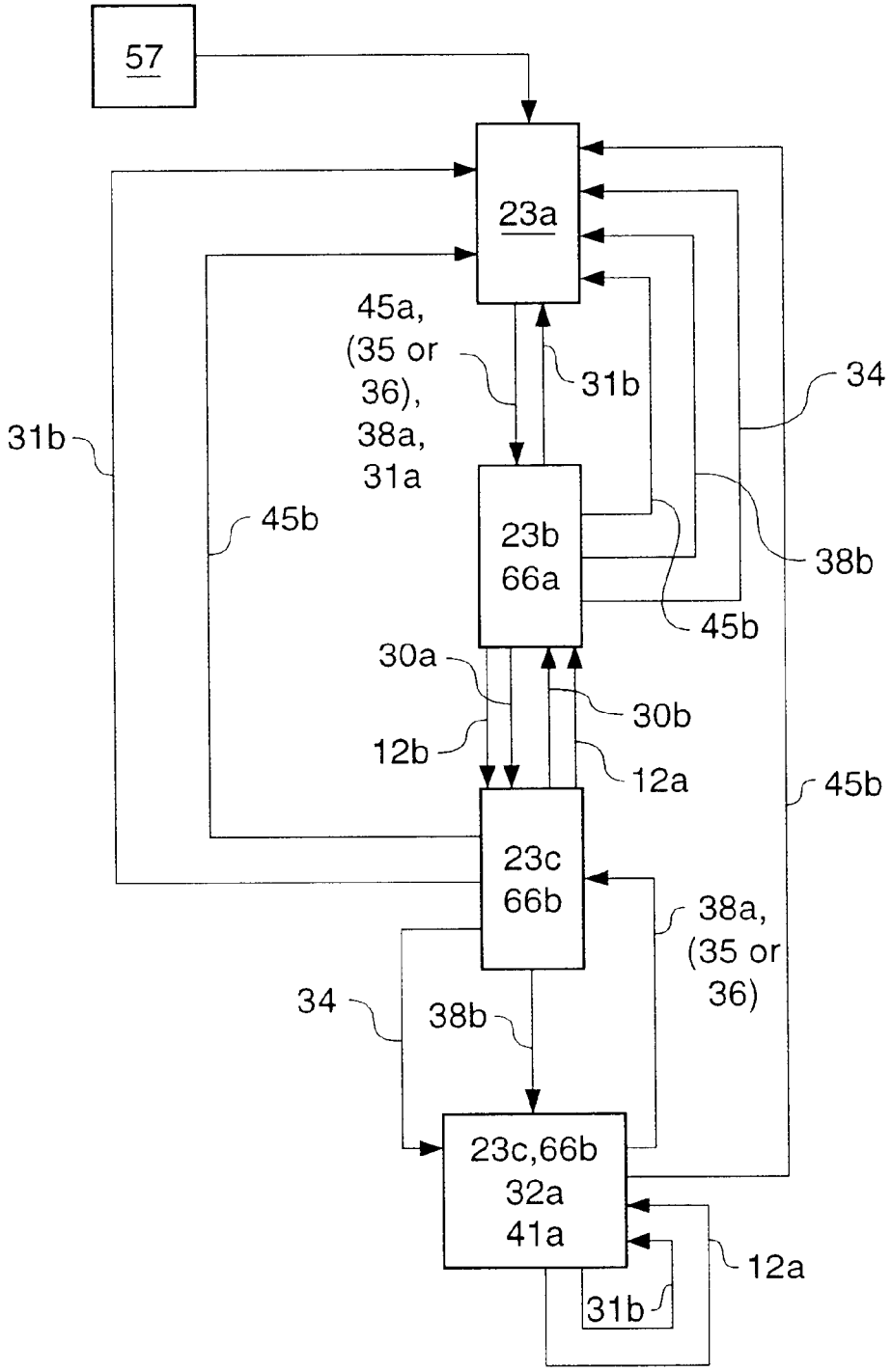
FIG. 5 is a logic flow chart of an engine speed reduction algorithm included within an electronic control module for the backhoe of FIGS. 1–3.

Referring to FIG. 5, there is shown a logic flow chart of an engine speed reduction algorithm 23 included within the electronic control module 24 of the seat assembly 22. The electronic control module 24 includes the engine speed reduction algorithm 23. The engine speed reduction algorithm 23 is inactive 23*a* when the seat assembly 22 is in the loader position 34. The engine speed reduction algorithm 23 is active 23*b* when the seat assembly 22 in the backhoe position 35. Preferably, the engine speed reduction algorithm 23 is also active 23*b* when the seat assembly 22 is in the middle-facing position 36. Although the engine speed reduction algorithm 23 is generally activated by rotating the seat assembly 22 to the backhoe position 35 or the middle-facing position 36, the operator can de-activate the engine speed reduction algorithm 23 by moving the engine speed disabling switch 31 to the de-activated position 31*b*, enabling the loader 13, at least in part, by moving the transmission controller 38 to the engaged position 38*b*, or moving the throttle controller 45 to the predetermined low idle speed setting 45*b*. Once the engine speed reduction algorithm 23 is activated 23*b*, the engine speed reduction algorithm 23 becomes operable 23*c* to reduce the engine speed below the increased throttle setting 45*a*, when the backhoe 12 is idle 12*b* for a predetermined time. Preferably, the engine speed reduction algorithm 23 will reduce the engine speed to the predetermined low idle speed 66*b*, illustrated as slower than 1000 rpm, after a predetermined time, such as four seconds. It should be appreciated that the engine speed reduction algorithm 23 could be programmed such that the predetermined time is any length of time. Once the engine speed reduction algorithm 23 is activated 23*b*, the engine speed reduction algorithm 23 also becomes operable 23*c* to reduce the engine speed from the increased throttle setting 45*a* to the predetermined low idle speed 66*b* when the engine speed reduction controller 30 is in the second position 30*a*.

However, once the engine speed reduction algorithm 23 has reduced the engine speed to the predetermined low idle speed 66*b*, the engine speed reduction algorithm 23 will return the engine speed to the increased engine speed 66*a* when the engine speed reduction controller 30 is again in the second position 30*b* or the backhoe 12 is operating 12*a*. Also, if the throttle controller 45 is moved anywhere between 45*a* and 45*b*, the algorithm will return the engine speed to the requested speed. The backhoe loader 10 includes an audible cue 41 that sounds 41*a*, and a display panel 32 (FIG. 1) that flashes 32*a*, when the engine speed is the predetermined low idle speed 66*b*, but the seat assembly 22 is in the loader position 34 or the transmission 37 is engaged. The engine speed will remain at the predetermined low idle speed 66*b* regardless of whether the engine speed reduction disabling switch 31 is in the de-activated position 31*b* and the backhoe 12 is in the operating position 12*a*. The engine reduction algorithm 23 will become inactive 23*a* if the hand-operated throttle controller 45 is moved to the predetermined low idle speed setting 45*b*.

INDUSTRIAL APPLICABILITY

Referring to FIGS. 1–3 and 5, there are shown side views of the backhoe loader 10 including the seat assembly 22, according to the present invention. Although the application of the present invention will be described for the backhoe loader 10, the present invention is applicable to any type or size of backhoe. Prior to activating the backhoe loader 10, the operator can preferably adjust his seat assembly 22 forward, backward, upward and downward in order to achieve his ideal positioning within the cab 19. Once situated, the operator can activate the backhoe loader 10 by moving a power switch 57 to an on position. Upon activation, the operator will position the seat assembly 22 in the loader position 34, the backhoe position 35, or the middle-facing position 36 depending on the function the operator would like the backhoe loader 10 to perform.

When the operator desires to operate the backhoe 12, the operator will generally position the seat assembly 22 in the backhoe position 35. The seat position sensor 44 will communicate to the electronic control module 24 via the sensor communication line 51 that the operator is in the seat assembly 22 and the seat assembly 22 is in the backhoe position 35. The electronic control module 24 will determine whether the engine speed reduction disabling switch 31 is in the activated position 31*a*. In order to operate the backhoe 12, the operator will generally position the transmission controller 38 in a neutral position 38*a*. Further, in order to operate the backhoe 12, the operator generally will move the hand-operated throttle controller 45 to the increased throttle setting 45*a*. The throttle setting 45*a* will open the throttle valve 52 wider in order to increase the fuel supply to the fuel injectors, and thus, increase the engine speed. The engine 39 can then power the hydraulic pump 50 that provides hydraulic fluid to the hydraulic cylinders via the electronically controlled actuators 62, 63, 64 and 65. The operator can operate the backhoe 12 by manipulating the first joystick 25 and the second joystick 26. The movement of the joysticks 25 and 26 will be communicated to the electronic control module 24, which will determine the desired movement of the backhoe 12 and correspondingly energize and/or de-energize the electrically controlled actuators 62, 63, 64, 65.

The electronic control module 24 will preferably periodically determined the engine speed. Although there are various methods of determining the engine speed, the electronic control module 24 can determine the engine speed based on the position of the throttle valve 52 that is communicated to the electronic control module 24 via the throttle communication line 48, or by a correctional speed sensor. Because the operator is operating or has just ceased operating the backhoe 12, the electronic control module 24 will determine that the hand-operated throttle controller 45 is at the increased throttle setting 45*a* corresponding to the increased engine speed 66*a*, which is illustrated as over 1100 rpm. As long as the operator has maintained the seat assembly 22 in the backhoe position 35 or the middle-facing position 36, the engine speed reduction algorithm is active 23*b*. Once the operator has completed operating the backhoe 12 for the moment, the operator will return the backhoe 12 to the idle position 12*b* by moving the joysticks 25 and 26 to the neutral positions 25*a* and 26*a*. The fact that the joysticks 25 and 26 are in the neutral positions 25*a* and 26*a* will be communicated to the electronic control module 24 via the first and second communication lines 27 and 28, respectively. When the backhoe 12 has been in the idle position 12*b* for the predetermined time, the engine speed reduction algorithm 23 will be operable 23*c* to reduce the engine speed from the throttle setting 45*a*, which corresponds with the increased engine speed 66*a*, to the predetermined low idle speed 66*b*. In the illustrated backhoe loader 10, the engine speed reduction algorithm 23 will reduce the engine speed from greater than 1100 rpm to less than 1000 rpm after the electronic control module 24 senses that the backhoe 12 has been idle 12*b* for four seconds. Thus, the amount of fuel being supplied to the fuel injectors and combusted in the engine 39 is decreased, thereby reducing fuel consumption, noise and pollution.

If the operator desires to operate the backhoe 12 again, the operator will move the first joystick 25 and/or the second joystick 26 out of the neutral positions 25*a* and/or 26*a*. The movement will be communicated to the electronic control module 24, and the engine speed reduction algorithm 23 will return the engine speed to the increased engine speed 66*a* by communicating to the throttle valve 52 via the throttle communication line 48 to return to the higher setting. Thus, the engine 39 will be able to sufficiently power the hydraulic pump 50 in order to operate the backhoe 12. The electronic control module 24 will determine the desired movement of the backhoe 12 and correspondly energize and/or de-energize the proper electrically-controlled actuators 62, 63, 64, 65.

Preferably, there is a second method of reducing the engine speed to the predetermined low idle speed 66*b* when the engine speed reduction algorithm 23 is active 23*b*, and returning the engine speed to the increased engine speed 66*a* when the engine speed reduction algorithm 23 is operable 23*c*. Rather than idling the backhoe 12 for the predetermined time in order for the engine speed reduction algorithm 23 to reduce the engine speed, the operator can make the engine speed reduction algorithm 23 operable 23*c* to reduce the engine speed from the increased throttle setting 45*a* to the predetermined low idle speed 66*b* by moving the engine speed reduction controller 30 to the second position 30*b*. Thus, instead of idling at an engine speed faster than the predetermined low idle speed 66*b* for a predetermined time, the operator can move the backhoe 12 to the idle position 12*b* and immediately move the engine speed reduction controller 30 to the second position 30*b*. In addition, when the operator desires to operate the backhoe 12 again which requires a return to the increased engine speed 66*a*, the operator can again move the engine speed reduction controller 30 to the second position 30*b* while the backhoe 12 is in the idle position 12*b*. The engine speed reduction algorithm 23 will return the engine speed to the increased engine speed 66*a*, corresponding with the increased throttle setting 45*a*.

If the operator desires to operate the loader 13, the engine speed reduction algorithm 23 must be de-activated 23*a* before the operator rotates the seat assembly 22 to the loader position 34. If the operator attempts to rotate the seat assembly 22 to the loader position 34 or engage the transmission 37 when the engine speed reduction algorithm 23 is operable 23*c* to reduce the engine speed to the predetermined low idle speed 66*b*, the engine speed will lock at the predetermined low idle speed 66*b*, the audible cue 41 will sound 41*a* and the display panel 32 will flash 32*a*. If the operator moves the engine speed reduction disabling switch 31 to the deactivated position 31*b* or moves the backhoe 12 to the operating position 12*a*, the audible cue 41 will continue to sound 41*a* and the display panel 32 will continue to flash 32*a*. The audible cue 41 and the display panel 32 will cease sounding and flashing and the engine speed reduction algorithm will become inactive 23*a* when the operator moves the hand-operated throttle controller 45 to the predetermined low idle speed setting 45*b* prior to rotating the seat assembly 22 to the loader position 34. Further, the audible cue 41 and the display panel 32 will cease sounding and flashing if the operator rotates the seat assembly 22 back to the backhoe position 35 or the middle-facing position 36 and the transmission 37 is disengaged. The engine speed reduction algorithm 23 can then be de-activated 23*a* by moving the engine speed reduction disabling switch 31 to the de-activated position 31*b* or moving the hand-operated throttle controller 45 to the predetermined low idle speed setting 45*b*.

Locking the engine speed at the predetermined low idle speed 66*b*, sounding the audible cue 41, and flashing the display panel 32 are all features that prevent the operator from operating the loader 13 while the engine speed reduction algorithm 23 is operable 23*c* to reduce the engine speed below the increased throttle setting 45*a*. In another machine, if an operator were able to operate the loader an operator might overlook that the throttle setting corresponds with the increased engine speed rather than the predetermined low idle speed at which the backhoe loader is idling. Thus, when the operator engages the transmission, the backhoe loader might jump back up to the increased throttle setting causing the backhoe loader to lurch forward. The present invention addresses this issue by preventing the loader from becoming active until after the speed reduction algorithm has been rendered inactive.

Once in the loader position 34, the electronic control module 24 will operably connect the first joystick 25 and the second joystick 26 to the loader 13. Because the operator often drives the backhoe loader 10 during operation of the loader 13, the transmission 37 will be engaged, and the engine speed required to operate the loader 13 can be achieved by the operator depressing the foot pedal 40. The engine speed reduction algorithm 23 will be inactive 23*a*.

It should be appreciated that the present invention contemplates a work machine 10 including default modes and override modes. When the seat assembly 22 is in a certain position, the joysticks 25 and 26 will preferably default to operate the equipment that the seat assembly 22 is facing. In the illustrated example, when the seat assembly 22 is in the loader position 34 and the backhoe position 35, the backhoe loader 10 will default to the loader mode in which the joysticks 25 and 26 are operably coupled to the loader 13 and the backhoe mode in which the joysticks 25 and 26 are operably coupled to the backhoe 12, respectively. When the seat assembly 22 is in the middle-facing position 36 and the backhoe 12 is enabled, the backhoe loader 10 will default to the backhoe mode. The operator can manipulate a switch in order to override the default mode and operably couple the joysticks 25 and 26 to the set of equipment 12 or 13 on the opposite side of the work machine body 11. In the loader position 34, the default can be overridden to operate the backhoe 12. However, those skilled in the art should appreciate that the backhoe 12 is rarely operated from the loader position 34. In the middle-facing position 36 and the backhoe position 35, the default mode could be overrode in order to operate in a hybrid mode in which the first joystick 25 is operably coupled to at least a portion of the loader 13 and the second joystick 26 is operably coupled to at least a portion of the backhoe 12. When in the middle-facing position 35 and the backhoe position 36, as long as the transmission 37 is not engaged and the engine speed reduction disabling switch 31 is in the activated position 31*a*, the engine speed reduction algorithm 23 will be activated 23*b*, regardless of whether the work machine 10 is in the backhoe mode or the hybrid mode. However, the default override mode for the loader position 34 is the backhoe mode. Regardless of whether the work machine 10 is in the loader mode or the backhoe mode, when the seat assembly 22 is in the loader position, the engine speed reduction algorithm 23 is inactive 23*a*. The activation and operation of the engine speed reduction algorithm 23 generally corresponds with the backhoe mode, and the de-activation of the engine speed reduction algorithm 23 will correspond with the loader mode.

Overall, the present invention is advantageous because it reduces fuel consumption, noise and pollution caused by the backhoe 10 having more than one function. The present invention recognizes that during the operation of the backhoe 12, often there are times when the operator will idle the backhoe 12. Because more power is required to operate than idle the backhoe 12, it is ideal for the operator to adjust the throttle controller 45 to correspond with a lower engine speed when the operator idles the backhoe 12. However, for those times when the operator does not adjust the throttle controller 45 to the low idle engine speed setting 45*b*, the present invention will adjust the throttle setting and thus the engine speed for the operator. Because of the adjusted throttle setting 44*b* corresponding with the lowered engine speed 66*b*, the engine will consume less fuel and will make less noise and pollution. Moreover, the present invention electronically reduces the engine speed when the backhoe 12 is idling, and thereby, reduces the amount of mechanical components leading to a more robust work machine.

The present invention is further advantageous because the engine speed reduction algorithm is de-activated 23*a* when the backhoe loader 10 is functioning in one of its capacities other than as the backhoe, such as a moving vehicle or as the loader. First, the present invention is generally not desirable when the loader 13 is being operated or the backhoe loader 10 is being driven because in both those instances the operator can control the throttle valve 52 via the foot pedal 40. Moreover, by deactivating the engine speed reduction algorithm 23 prior to enabling the loader 13 avoids unwanted lurching movements of the backhoe loader 10. If the engine speed reduction algorithm 23 remained operable 23*c* when the loader 13 was enabled by rotating the seat assembly 22, the throttle setting would jump from the predetermined low idle speed 66*b* to the increased throttle setting 45*a* when the transmission 37 was engaged, causing the backhoe loader 10 to lurch forward. Thus, the present invention is advantageous because it recognizes and addresses the differences in the operation of the backhoe 12 and the loader 13, and adjusts the engine speed reduction algorithm 23 to compensate for those differences.

It should be understood that the above description is intended for illustrative purposes only, and is not intended to limit the scope of the present invention in any way. Although the present invention was illustrated in the context of a backhoe loader, the present invention could also be applicable to other machines in which seat position generally determines which aspect of the machine operation is active. Thus, the present invention contemplates other machines such as pavers, graders, certain mining equipment, and other similar work machines known in the art. Thus, those skilled in the art will appreciate that other aspects, objects, and advantages of the invention can be obtained from a study of the drawings, the disclosure and the appended claims.

What is claimed is:

1. A work machine, comprising:

a work machine body;

a seat assembly being rotatably mounted to the work machine body and being moveable between a first position and a second position;

an electronic control module including an engine speed reduction algorithm; and the engine speed reduction algorithm being inactive when the seat assembly is in the first position; and the engine speed reduction algorithm being active when the seat assembly is in the second position.

2. The work machine of claim 1 wherein the engine speed reduction algorithm being operable to reduce engine speed below a throttle setting when a set of equipment is idle for a predetermined time.

3. The work machine of claim 2 wherein the engine speed reduction algorithm being operable to reduce engine speed to a predetermined low idle speed when the throttle setting is greater than the predetermined low idle speed.

4. The work machine of claim 3 wherein the seat assembly includes a middle position between the first position and the second position; and the engine speed reduction algorithm being active when the seat assembly is in the middle position.

5. The work machine of claim 1 including an engine speed reduction disabling switch being moveable between an first position and a second position; and when the engine speed reduction disabling switch is in the second position, the engine speed reduction algorithm is inactive.

6. The work machine of claim 1 including an engine speed reduction controller being moveable between a first position and a second position; and when the engine speed reduction controller is in the second position and a set of equipment is idle, the engine speed reduction algorithm being operable to reduce the engine speed from a throttle setting to a predetermined low speed.

7. The work machine of claim 1 including a loader attached to a front side of the work machine body; and a backhoe attached to a rear side of the work machine body.

8. The work machine of claim 4 including:

an engine speed reduction disabling switch being moveable between a first position and a second position; and when the engine speed reduction disabling switch is in the second position, the engine speed reduction algorithm is inactive;

an engine speed reduction controller being moveable between a first position and a second position; and the engine speed reduction algorithm being operable to reduce engine speed below the throttle setting when the engine speed reduction controller is in the second position and the set of equipment is idle; and a loader being attached to a front side of the work machine body, and the set of equipment being a backhoe attached to a rear side of the work machine body.

9. The work machine of claim 8 wherein the engine speed reduction algorithm is inactive when at least one of the seat assembly is in said first position, the backhoe is active, and the loader is enabled.

10. A control system for use in a work machine, comprising;

a seat assembly position sensor;

an electronic control module including an engine speed reduction algorithm in communication with said sensor to determine a position of a seat assembly; and the engine speed reduction algorithm being inactive when the electronic control module determines the seat assembly is in a first position; and the engine speed reduction algorithm being active when the electronic control module determines the seat assembly is in a second position.

11. The control system of claim 10 including at least one implement controller in communication with the electronic control module; and the engine speed reduction algorithm being operable to reduce engine speed below a throttle setting when the electronic control module determines that the at least one implement controller is in a neutral position for a predetermined time.

12. The control system of claim 11 including an engine speed reduction controller being moveable between a first position and a second position; and the engine speed reduction algorithm being operable to reduce engine speed below a throttle setting when the electronic control module determines that the at least one implement controller is in the neutral position and the engine speed reduction controller is in the second position.

13. The control system of claim 12 including an engine speed reduction disabling switch being in communication with the electronic control module; and when the engine reduction disabling switch is in a second position, the engine speed reduction algorithm is inactive.

14. The control system of claim 13 wherein the seat assembly includes a middle position between the first position and the second position; and the engine speed reduction algorithm being active when the electronic control module determines that the seat assembly is in the middle position.

15. A method of operating a work machine, comprising the steps of:

activating an engine speed reduction algorithm, at least in part, by rotating a seat assembly from a first position to a second position; and reducing engine speed below a throttle setting via the engine speed reduction algorithm, at least in part, by idling a set of equipment for a predetermined period of time.

16. The method of claim 15 wherein the step of reducing includes a step of idling a set of equipment at the throttle setting corresponding with an engine speed greater than a predetermined low speed.

17. The method of claim 15 including a step of reducing engine speed below the throttle setting via the engine speed reduction algorithm, at least in part, by manipulating an engine speed reduction controller.

18. The method of claim 15 including a step of deactivating the engine speed reduction algorithm by at least one of rotating the seat assembly to the first position, manipulating an implement controller operably coupled to the set of equipment, and enabling a second set of equipment.

19. The method of claim 15 including a step of deactivating the engine speed reduction algorithm by manipulating an engine speed reduction disabling switch.

20. The method of claim 15 including a step of activating the engine speed reduction algorithm by rotating the seat assembly to a middle position and moving an engine speed reduction disabling switch from a first position to a second position.

21. A method of enabling an aspect of a work machine, comprising the steps of:

rotating a seat assembly from a first position to a second position;

activating an engine speed reduction algorithm; and rotating the seat assembly from the second position to the first position after de-activating the speed reduction algorithm.

22. The method of claim 21 including a step of alerting an operator if the engine speed reduction algorithm is active and the seat assembly is in the first position.

23. The method of claim 21 wherein the engine speed reduction algorithm is de-activated at least in part by moving a throttle to a reduced speed setting.

24. The method of claim 21 wherein the aspect is a loader of a backhoe.

* * * * *